US006746008B2

(12) United States Patent
Coombs et al.

(10) Patent No.: US 6,746,008 B2
(45) Date of Patent: Jun. 8, 2004

(54) SET FINISHING DEVICE HAVING A SINGLE MOTOR DRIVEN APPARATUS FOR POSITIONING THE SET FINISHING DEVICE IN A PLURALITY OF DIFFERENT FINISHING STATIONS AND MOVING THE SET FINISHING DEVICE INTO AND OUT OF FINISHING POSITION

(75) Inventors: Peter M. Coombs, Tustin, CA (US); Niels Hvid, Vedbaek (DK)

(73) Assignee: Gradco (Japan) Ltd. (JP)

( * ) Notice: Subject to any disclaimer, the term of this patent is extended or adjusted under 35 U.S.C. 154(b) by 165 days.

(21) Appl. No.: 10/103,599

(22) Filed: Mar. 21, 2002

(65) Prior Publication Data

US 2003/0178760 A1 Sep. 25, 2003

(51) Int. Cl.[7] ..... B42B 5/00; B27F 7/19
(52) U.S. Cl. ..... 270/58.08; 270/58.13
(58) Field of Search ..... 270/58.08, 58.11–58.13; 399/407, 408, 410

(56) References Cited

U.S. PATENT DOCUMENTS

| | | | | |
|---|---|---|---|---|
| 5,064,181 A | * | 11/1991 | Hosoi et al. | 270/58.18 |
| 5,642,876 A | * | 7/1997 | Ferrara et al. | 270/58.01 |
| 5,713,566 A | | 2/1998 | Coombs et al. | |
| H1842 H | * | 3/2000 | Tontarski | 227/100 |
| 6,223,965 B1 | * | 5/2001 | Nakatsuka | 227/111 |
| 6,450,934 B1 | * | 9/2002 | Coombs | 493/383 |

* cited by examiner

*Primary Examiner*—Christopher P. Ellis
*Assistant Examiner*—Mark A. Deuble

(57) ABSTRACT

A set finishing apparatus and method adapted for use with an image producing machine discharging sheets of paper in sets that are arranged for finishing is disclosed which may comprise: a moveable set finishing unit having a home position and a plurality of set finishing station positions located generally along a longitudinal axis, and having at least at each finishing station position a retracted position and an operating position, with each respective finishing station retracted position and operating position displaced from each other generally orthogonally to the longitudinal axis; a drive motor having an output drive shaft; a translational drive mechanism comprising a rotating shaft mounted generally parallel to the to the longitudinal axis and operatively connected to the drive motor output drive shaft and adapted to rotate in a rotating direction in response to rotation of the drive motor output drive shaft in a rotating direction; and, the moveable set finishing station being operatively connected to the rotating shaft of the translational drive mechanism in such a way as to be moved sequentially through each of the set finishing station positions and returned to the home position without changing the rotating direction of the drive motor output drive shaft or the rotating direction of the translational drive mechanism rotating shaft. The translational drive mechanism may be adapted to move the moveable set finishing unit out of the retracted position and into the operating position by changing the rotating direction of the drive motor output shaft. The translational drive mechanism rotating shaft may further comprise: an generally cylindrical outer surface of the rotating shaft having formed therein a traveling track groove; and the moveable set finishing unit may further comprise: a traveling track groove follower attached to the moveable set finishing unit and adapted to engage the traveling track groove and move within the traveling track groove when the translational drive mechanism rotating shaft is rotated.

81 Claims, 7 Drawing Sheets

SET FINISHING DEVICE HAVING A SINGLE MOTOR DRIVEN APPARATUS FOR POSITIONING THE SET FINISHING DEVICE IN A PLURALITY OF DIFFERENT FINISHING STATIONS AND MOVING THE SET FINISHING DEVICE INTO AND OUT OF FINISHING POSITION

FIELD OF THE INVENTION

The present invention relates to mechanisms for translating and positioning set finishing apparatus in machines adapted to provide finishing in the way of, e.g., stapling, to a set of sheets produced by an image producing machine, e.g., a copier or a printer.

BACKGROUND OF THE INVENTION

It is well known in the art to provide set finishing apparatus for machines that produce sheets of paper or other image receiving materials, e.g., printers and copiers, which can position a finishing apparatus, e.g., a stapler, in a plurality of locations, as desired. This may be done, e.g., to corner staple a set of sheets or alternatively to staple the sheets at a plurality of locations along, e.g., one edge of a set of sheets. Typically such apparatus require at least two stapling devices and at least two separate motors and complicated gearing and timing mechanisms that add to the cost of such image producing machines as well as to the footprint of the set finishing portion of the machine. A need exists, therefore, for an improved set finishing apparatus that both reduces the number of finishing devices, e.g., staplers, and the number of motors, as well as reduces the required footprint.

SUMMARY OF THE PRESENT INVENTION

A set finishing apparatus and method adapted for use with an image producing machine discharging sheets of paper in sets that are arranged for finishing is disclosed which may comprise: a moveable set finishing unit having a home position and a plurality of set finishing station positions located generally along a longitudinal axis, and having at least at each finishing station position a retracted position and an operating position, with each respective finishing station retracted position and operating position displaced from each other generally orthogonally to the longitudinal axis; a drive motor having an output drive shaft; a translational drive mechanism comprising a rotating shaft mounted generally parallel to the to the longitudinal axis and operatively connected to the drive motor output drive shaft and adapted to rotate in a rotating direction in response to rotation of the drive motor output drive shaft in a rotating direction; and, the moveable set finishing station being operatively connected to the rotating shaft of the translational drive mechanism in such a way as to be moved sequentially through each of the set finishing station positions and returned to the home position without changing the rotating direction of the drive motor output drive shaft or the rotating direction of the translational drive mechanism rotating shaft. The translational drive mechanism may be adapted to move the moveable set finishing unit out of the retracted position and into the operating position by changing the rotating direction of the drive motor output shaft. The translational drive mechanism rotating shaft may further comprise: an generally cylindrical outer surface of the rotating shaft having formed therein a traveling track groove; and the moveable set finishing unit may further comprise: a traveling track groove follower attached to the moveable set finishing unit and adapted to engage the traveling track groove and move within the traveling track groove when the translational drive mechanism rotating shaft is rotated. The traveling track groove may further comprise: a generally helical groove having a first translational section adapted to move the traveling track groove follower in a first translational direction when the translational drive mechanism rotating shaft is rotated in the rotating direction such that the moveable set finishing station moves in the first translational direction to a position of maximum displacement along the longitudinal axis in the first translational direction and a second translational section adapted to move the traveling track groove follower in a second translational direction generally the reverse of the first translational direction and away from the position of maximum displacement along the longitudinal axis when the translational drive mechanism rotating shaft is continued to rotate in the rotating direction. In at least one of the first translational section and the second translational section the generally helical groove may further comprise at least one generally flattened portion aligned with at least some of the plurality of finishing stations and adapted to permit motion of the traveling track groove follower in a direction generally orthogonal to the longitudinal axis, and the traveling track groove may further comprise a generally flattened portion positioned at the position of maximum displacement in the first translational direction. The position of maximum displacement in the first translational direction may also be one of the plurality of set finishing stations. The apparatus and method may further comprise: a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position; and, a wedge engaging member contained on the moveable finishing unit and adapted to engage the curved surface on the wedge plate as the moveable finishing unit moves in the direction of movement from the retracted position to the operating position, to thereby pivot the pivotally mounted tray away from the moveable finishing unit. The finishing unit may comprises an electrically operated finishing mechanism; and, movement of the moveable finishing unit at a respective finishing station from the retracted position to the operating position mechanically may actuate an electrical switch to operate the moveable finishing unit to perform the finishing operation. The finishing unit may be a stapler.

DETAILED DESCRIPTION OF A PREFERRED EMBODIMENT

Figure 1:
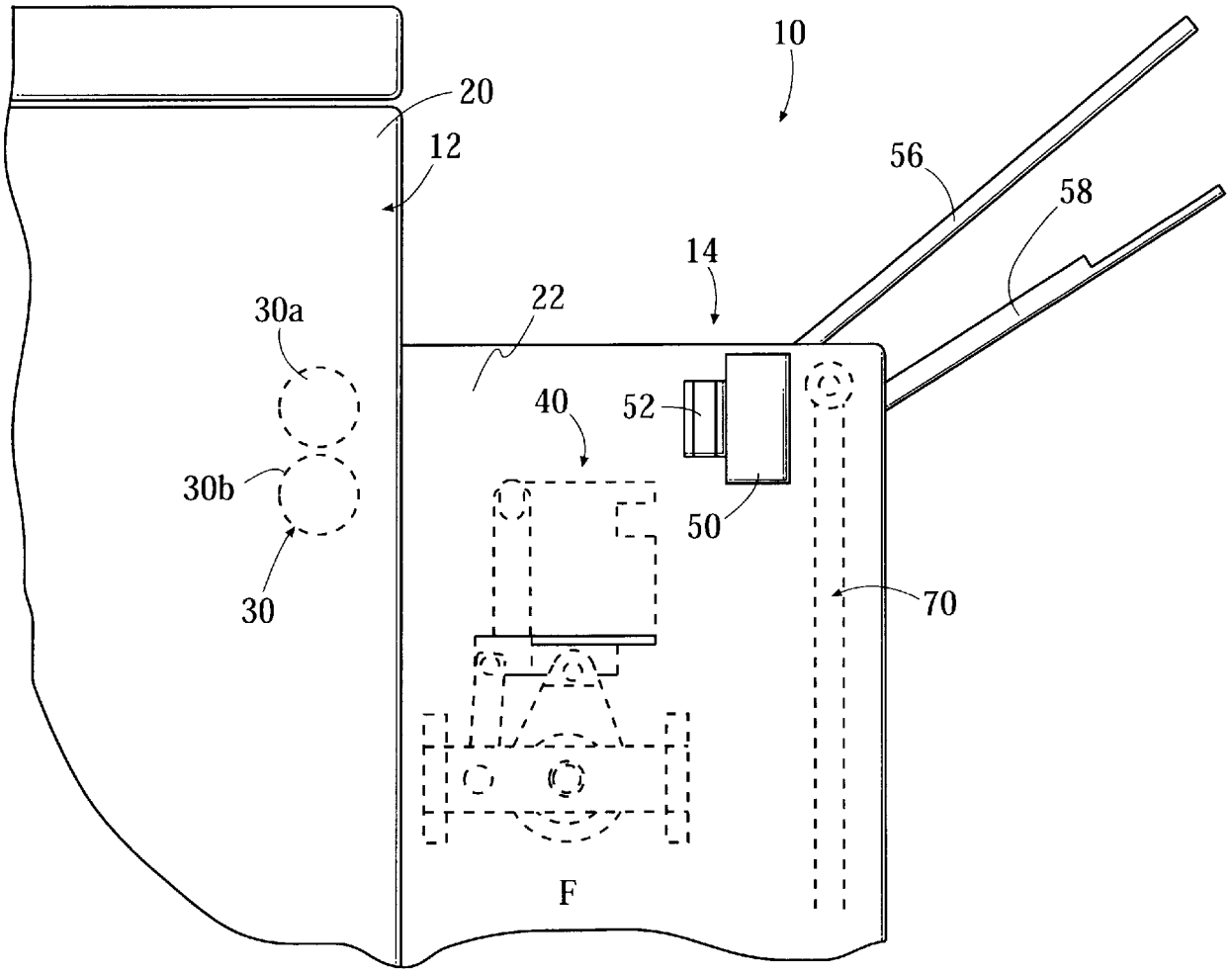
FIG. 1 shows a front view of an image producing machine having a set finishing apparatus according to an embodiment of the present invention.

Turning now to FIG. 1 there is shown a front view of a system 10 according to an embodiment of the present invention, having an image producing machine 12 and a set finisher 14 according to an embodiment of the present invention. The image producing machine 12 may be, e.g., a copier or a printer and may have a housing 20. Typically, such an image producing machine 12 will have a paper discharge mechanism 30, which may, e.g., comprise a pair of discharge rollers 30*a* and 30*b*.

The finisher 14 may also perform other functions, such as sorting, but for simplicity here the only function to be described in regard to the finisher 14 will be forms of finishing, e.g., binding sets of sheets, e.g., by stapling. The finisher/stapler 14, may have a housing 22 within which may be included a finishing apparatus 40 according to an embodiment of the present invention. For convenience and convention the view seen in FIG. 1 will be referred to as the front or front-side view, as the opposite side of the system 10 will typically be against a wall and the operator will face the front side as viewed in FIG. 1. For this reason also, the right side of the apparatus 10 as viewed in FIG. 1 will be considered the right side view of the apparatus 10.

Also seen in the front side view of FIG. 1 are a sheet aligning apparatus 50 and a sheet aligning motor 52, which can serve to align image bearing sheets received from the discharge rollers 30*a* and 30*b*. Further the view of FIG. 1 shows an upper tray 56 and a lower tray 58, which may be positioned as show in FIG. 1.

Figure 2:
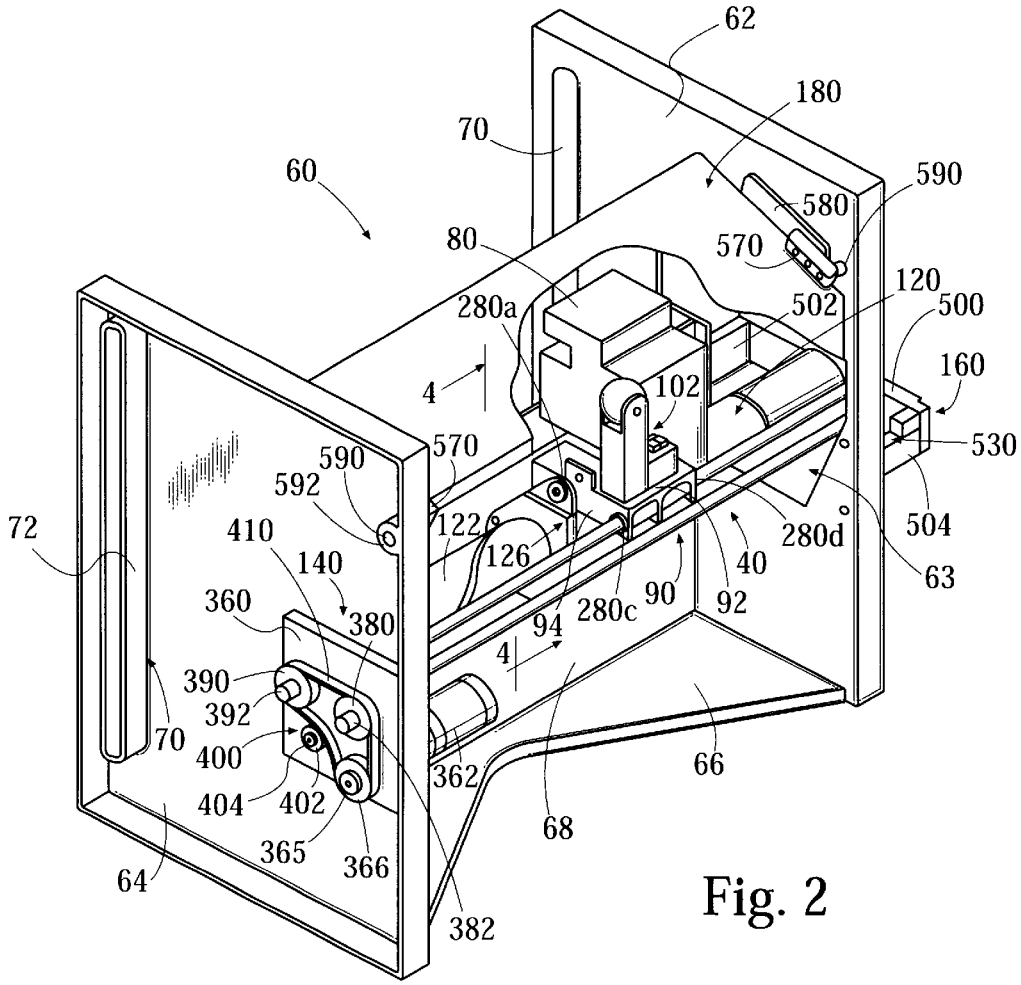
FIG. 2 shows a partially cut-away perspective view of the apparatus of FIG. 1.
Figure 3:
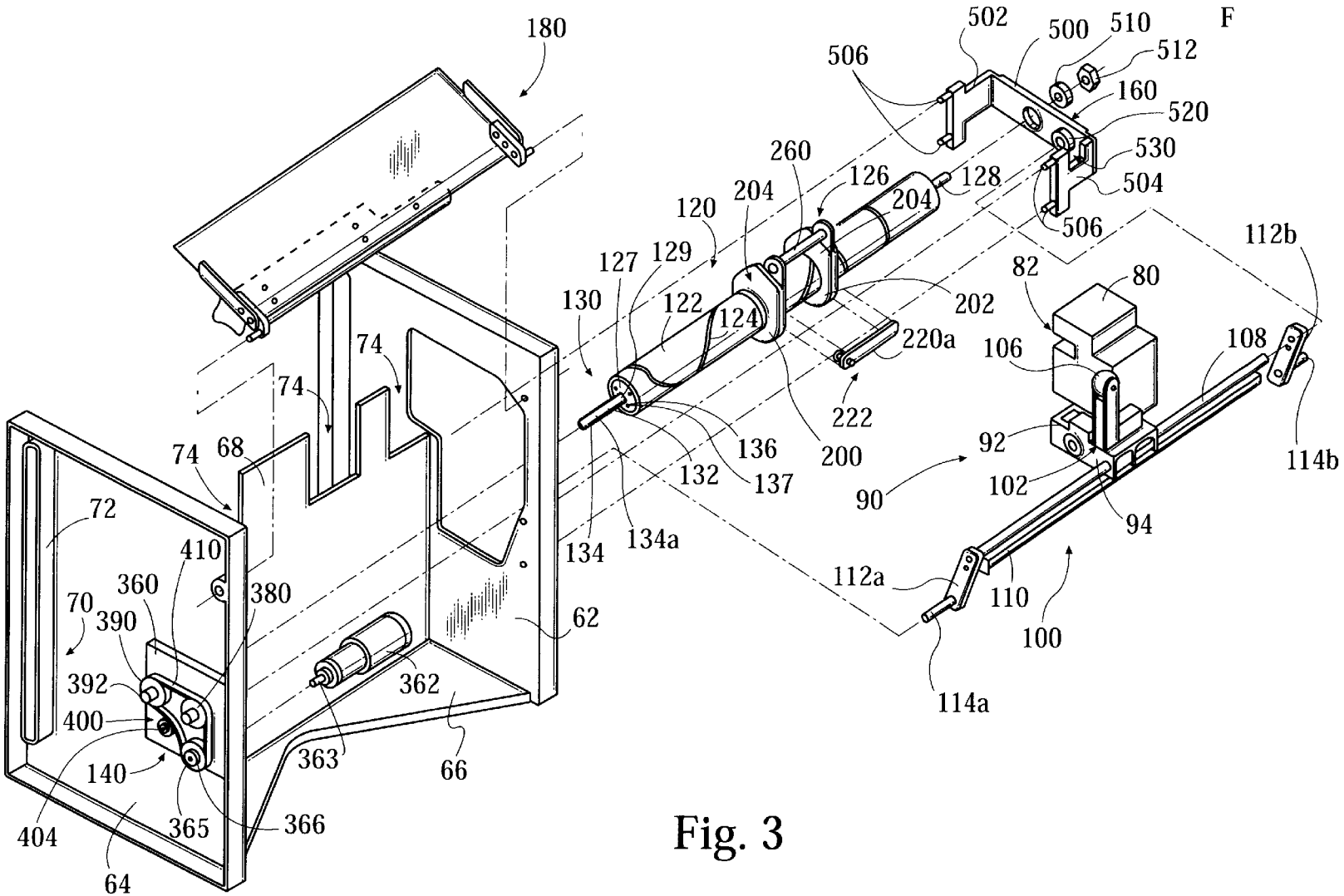
FIG. 3 shows a partially exploded perspective view of the apparatus of FIGS. 1 and 2.

Turning now to FIGS. 2 and 3 there is shown, respectively, a partially cut-away and a partially exploded perspective view of the apparatus of FIG. 1, as seen from the front and right sides of the embodiment of the present invention as shown in FIG. 1. A set finishing apparatus 40, may be mounted on a frame 60, which may have a front side wall 62, a rear side wall 64 and a floor 66, and may also include a vertical center wall 68. Each of the front side wall 62 and rear side wall 64 may have a vertically extending slot 70, shown in FIG. 2 for each of the front side wall 62 and rear side wall 64 of the frame 60, and shown in phantom in FIG. 1 for the front side wall 62 of the frame 60 in FIG. 1. Each of the front side wall 62 and rear side wall 64 slots 70 may have an exterior slot wall 72, as shown in FIG. 2 for the rear side wall 64 of the frame 60. The vertical center wall 68 may also include a plurality of openings 74 to accommodate movement of the finisher/stapler assembly 40, as described in more detail below.

The frame 60 can support the finisher/stapler apparatus 40, which may include a finisher/stapler 80. The finisher/stapler 80 may be mounted on a finisher/stapler carrier assembly 90, which may include a horizontally extending carrier base plate 92, also shown in more detail in FIG. 8, which may also include a vertically extending rear side wall 94 and a vertically extending front side wall 96 (shown in FIG. 8) each extending below the carrier base plate 92.

Figure 4:
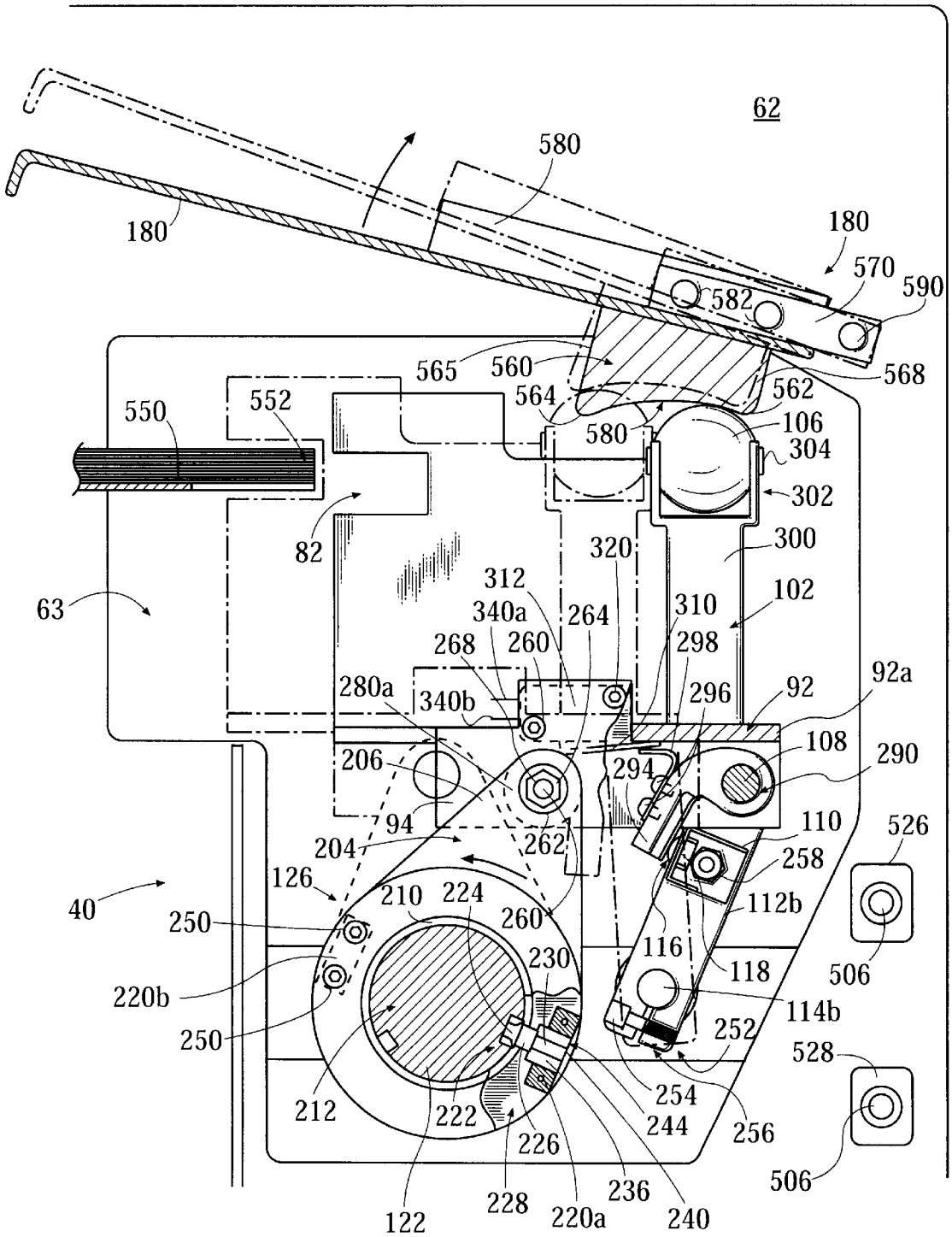
FIG. 4 shows a partially cut away frontal side view of the apparatus of FIG. 2 along lines 4—4 in FIG. 2.
Figure 8:
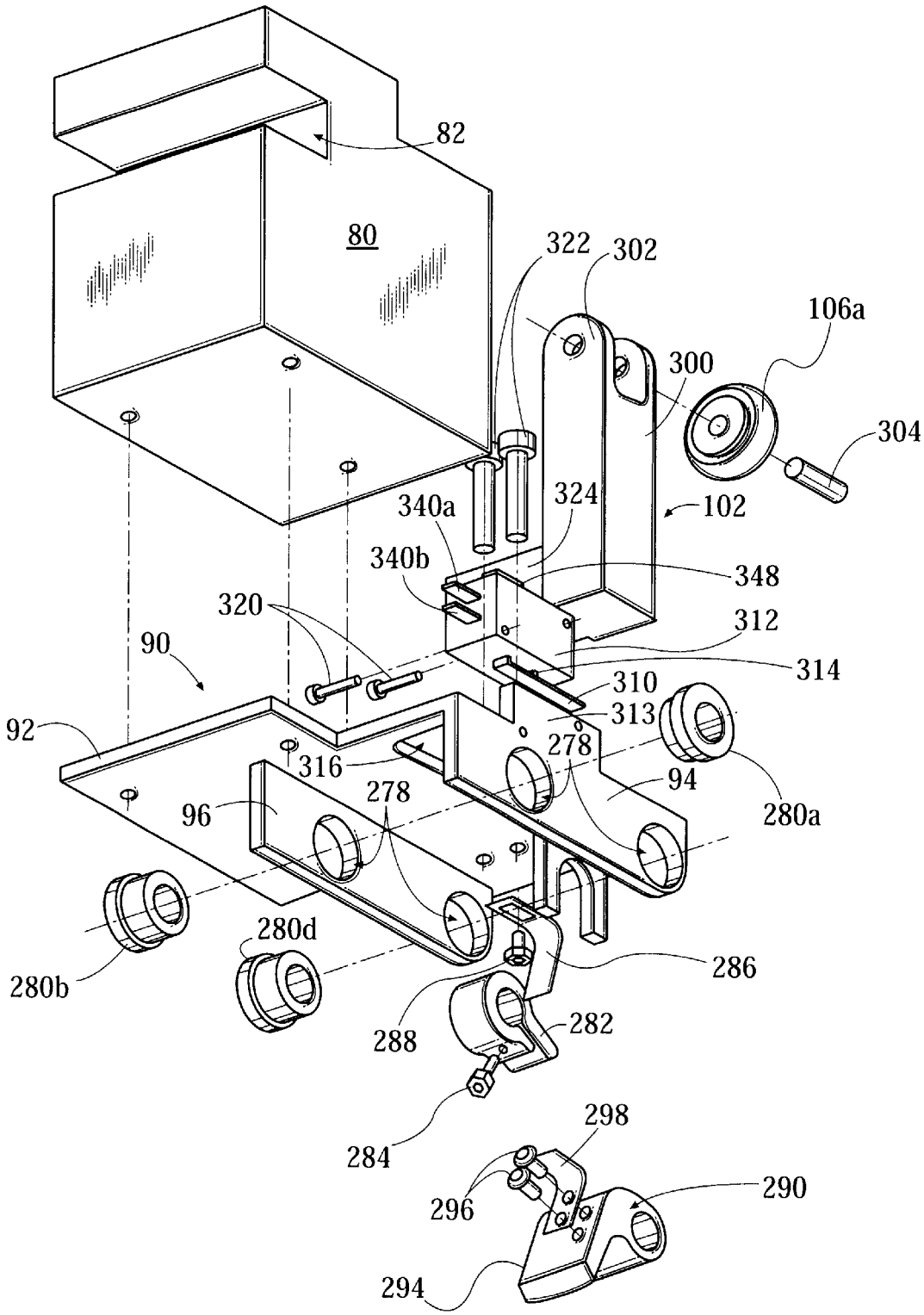

Also mounted on the carrier base plate 92 may be a wedge roller assembly 102, which may include a wedge roller ball 106 as is shown in more detail, e.g., in FIG. 4. The wedge roller ball 106 may be attached to a tower 300 of the wedge roller assembly 102 by a u-shaped portion 302 and a wedge roller pin 304 extending between the opposing sides of the u-shaped portion 302 of the tower 300. Alternatively the roller ball 106 may be configured as more of a flattened roller, e.g., 106*a* as illustrated in FIG. 8. The carrier assembly 90 may be slideably mounted on a translation mechanism 100, which may include a translation mechanism axle 108 and a translation mechanism switch beam 110, each of which may be pivotally mounted at respective ends thereof to one of a translation mechanism rear link bar 112*a* and a translation mechanism front link bar 112*b*. The translation mechanism rear link bar 112*a* and the translation mechanism front link bar 112*b* may be pivotally connected, respectively to the rear wall 64 of the frame 60 and the front wall 62 of the frame 60 by a respective one of a pair of translation mechanism link pivot pins 114*a* and 114*b*.

The translation mechanism carrier plate 92 may also be attached to a union assembly 126, as is shown in more detail, e.g., in FIG. 4, by a union assembly axle 260. The union assembly 126 may be slideably mounted on a helix shaft 122, which may for a part of a translation helix assembly 120, and which may include a helix groove 124, which may be variably pitched. The helix groove 124 may have relatively high pitched translation portions 124*a* (as shown in more detail in FIG. 5), which may have a pitch that will cause the union assembly 126 to move along the translation portion 124*a* of the helix groove 124 when the helix shaft 122 is rotated in a clockwise direction as shown in FIGS. 2 and 3. The helix groove 124 may also have a plurality of generally significantly reduced pitch portions 124*b*, which may be utilized as explained in more detail below.

The helix 122 may be formed of a generally solid or hollow cylindrical structure made from a suitable, material, e.g., a plastic, such as Teflon. The helix 122 may have generally hollow end regions. This generally hollow end region at each end of the helix 122 can support, e.g., at the Helix 122 fixed end a fixed end end plate 127, which may included an axle 129. The axle 129 may be integrally formed on the end plate 127. The Helix 122 fixed end axle 129 may be formed, e.g., by machining, with a narrowed section 132, the terminal end of which narrowed section 132 may be threaded with threads 134 and also be formed with flat side walls 134*a*. The Helix 122 fixed end end plate 127 may be attached in the hollowed out portion at the end of the helix 122 by, e.g., a pair of hex socket cap screws 136, which may be, e.g., low head M4X16 cap screws, and by a pair of pins 137, which may be 04x20 pins.

At the free end of the helix 122 there may similarly be formed an end plate (not shown in FIG. 3), which may be attached to the helix 122 in a similar fashion as the helix 122 fixed end end plate 127. The Helix 122 free end end plate (not shown) may include an integrally formed helix 122 free end axle 128. The helix 122 free end axle 128 may also include a threaded terminal end portion (not shown in FIG. 3), which may be formed without the flattened side walls, such as the flattened side walls 134*a* of the terminal end of the helix 122 fixed end axle 130.

The helix 122 and the translation mechanism 100 axle 108 and switch beam 110 may be mounted at the fixed ends of each to the rear wall 64 of the frame 60 by link mechanism fixed end plate 140, as described in more detail below. The helix 122 and the translation mechanism 100 axle 108 and switch beam 110 may be attached to the front end wall 62 of the frame 60 by a free end link mechanism 160. The free end link assembly may be outside of the frame 60 and the helix 122 may extend to the free end link mechanism 160 through an opening 63 in the front side wall 62 of the frame 60.

Also a paper guide plate assembly 180 may be pivotally attached to the front end wall 62 and the rear end wall 64 of the frame 60.

As shown in FIGS. 2 and 3, the union assembly 126 may include a rear union arm 200 and a front union arm 202, each of which may be formed of a suitable material, e.g., aluminum and formed in the shape of a short hollow cylindrical section having a tapered region 204 extending from one side of each of the front and rear arms 200, 202. The rear union arm 200 and the front union arm 202 may be joined by a standoff 220*a* and a standoff 220*b* (shown, e.g., in FIG. 4), each of which, as shown in more detail, e.g., in FIG. 4, may be attached at respective ends to the rear union arm 200 and the front union arm 202 by a pair of screws 250, which may be, e.g., hex socket cap screws M3X12. As is shown in more detail, e.g., in FIG. 4, the hollow cylindrical portion of each of the rear union arm 200 and front union arm 202 may be fitted with a sleeve bearing 210. The sleeve bearing 210 made of a suitable material, e.g., Teflon, for facilitating the sliding movement of the union assembly 126 over the helix 122. The helix 122 slideably moves within an opening 212 internal of the sleeve bearing 210.

Referring again to both FIG. 3 and FIG. 4 it can be seen that the union assembly standoff 220*a* may include a helix follower 222. The helix follower 222 may be constructed of a guide boat 224. The guide boat 224 may be formed as a generally rectilinear plug, which may have a tapered end for facilitation of motion in one direction through the helix groove 124, or with a taper on both ends of the follower 224, as illustrated, e.g., in FIG. 4. The helix follower boat 224 may be integrally formed with a helix follower shaft 230 having an expanded collar portion 226. The shaft 230 may be held in place in an opening in the standoff 220*a* by a bearing 236, which may be, e.g., an oil bronze bearing, e.g., ISO 2795 O5/O10x6, and may be held in place by an external retaining clamp 244, which may fit into a slot (not shown) at the end of the shaft 230 formed by a flanged end 240 on the shaft 230, and may conveniently be protected by residing in a recess (also not shown) formed in the standoff 220*a*. It will be understood, therefore, that the shaft 230 and therefore also the follower boat 224 are attached for pivotal motion with respect to the standoff 220*a* to facilitate the elongated follower boat 224 passing along the pitched grove 124 of the helix 122.

The union assembly 126 may also include a union assembly axle 260 mounted to each of the rear union arm 200 and the front union arm 202 at generally the tapered extensions 204 of each, as can be seen in more detail in FIG. 4. The tapered portions 204 of each of the rear union arm 200 and the front union arm 202 may have a recessed portion 206. The terminal end portions of the ends of the union assembly axle 260 may be a threaded portion 268. The threaded portions 268 may extend through an opening in the recessed portion 206 of the tapered portion 204 and be secured in place with a washer 262 and a hex nut 264. Alternatively one end or both can be secured with a washer and a hex socked cap screw, e.g., a M6x16 that extends through the opening in the recess 206 in the tapered portion 204 and into a threaded opening (not shown) in the axle 260.

Turning now to FIGS. 2 and 3, there is illustrated the mounting of the helix 122 and translation assembly 100 at the fixed end on a fixed end mounting plate 360. The fixed end mounting plate 360 may be attached to the external side of the rear side wall 64 of the frame 60 by, e.g., bolting the fixed end mounting plate 360 to the side wall side wall 64 of the frame 60, e.g., with nuts and bolts and washers (not shown). The fixed end mounting plate 360 may have an opening through which extends a shaft 363 of a motor 362, which may be a permanent magnet DC motor, such as that manufactured by Johnson Electric Engineering under the name Johnson Motor and Model No. 76031. The motor 362 may be secured to the fixed end mounting plate by a plurality of screws, e.g., hex socket cap screws M3x10 (not shown), which may extend through the fixed end mounting plate 360 and into corresponding threaded openings in the motor 362 or into the housing of the motor 362, or a suitable bracket supporting the motor (not shown) as will be well understood. The drive shaft 363 may extend through an opening in the fixed end mounting plate 360 and be engaged by a motor pulley 366 by virtue of the drive shaft extending into a drive adapter 365, such as an ETP 8, which in turn extends through a central opening in the motor pulley 366 and provides connection of the drive shaft 363 to the drive pulley 366.

Also mounted on the fixed end mounting plate 360 can be a translation assembly pivot clutch pulley 380. There are a number of ways in which the translation assembly link pivot pin 114*a* can be attached to the translation assembly pivot clutch pulley 380, for movement when the shaft of the motor 362 reverses direction, as will be described in further detail below. None of these are illustrated in detail. However, basically a one way clutch 365 may be mounted with or incorporated with the pulley 366. In this manner rotation of the pulley 366 in one direction (e.g., the clockwise direction as shown in FIGS. 2 and 3) does not engage the pivot pin 114*a*, while rotation of the pulley 366 in the opposite direction does engage the pivot pin 114*a*. This then serves to rotate the translation assembly pivot arm 112*a* in the counterclockwise direction as shown in FIGS. 2 and 3, when the shaft 363 is rotated in the counterclockwise direction.

By way of example, the fixed end mounting plate 360 may include an opening (not shown), which may include a spacer ring (not shown) through which may extend an oil bronze bearing (not shown) which may be an ISO 2795 O10/O16x6-O22x3 bearing, having an internal opening through which can extend the pivot pin 114*a*. The one way clutch 365 may engage the end of the pivot pin 114*a* extending through the pulley 380 and/or this may be done by a retainer for the clutch 365.

Also by way of example, a helix drive pulley 390 may be mounted to the fixed end mounting plate 360 in a variety of ways, which are not shown in detail. The fixed end mounting wall 360 may have an opening containing a radial ball bearing (not shown) which may be a 608 2 RS1 O8 radial ball bearing, which may be held in place by a bearing retainer plate (not shown), which in turn may be fastened to the fixed end mounting plate by a plurality of screws, e.g., button head cap screws M3x8. Also included may be a retainer (not shown) for the helix axle 130. The helix drive pulley 390 may include a circular opening (not shown), which may be threaded to engage the threaded portion 134 of the helix axle 130, and also a rectilinear portion (not shown) including a pair of parallely placed pins in the rectilinear opening to engage the flat side wall portions 134*a* of the helix axle 130. The assembly may be secured using a hex nut M8 392. The pulley assembly may include geared pulleys and an appropriate pulley belt 410 to provide for minimum slippage of the belt 410 over the pulleys 366, 380 and 390. The pulley belt 410 may be tensioned by a tensioning mechanism 400, which may include a radial ball bearing 402, which may be separated from the fixed end mounting plate 360 by a cylindrical standoff (not shown) and may be attached utilizing a hex nut 404, e.g., a M6, and may include an associated washer (not shown). The fixed end mounting plate 360 may include a generally vertically displaced slot for securing the tensioner 400 in engagement with the pulley belt 410 in a plurality of selectable tensioning positions.

Figure 5:
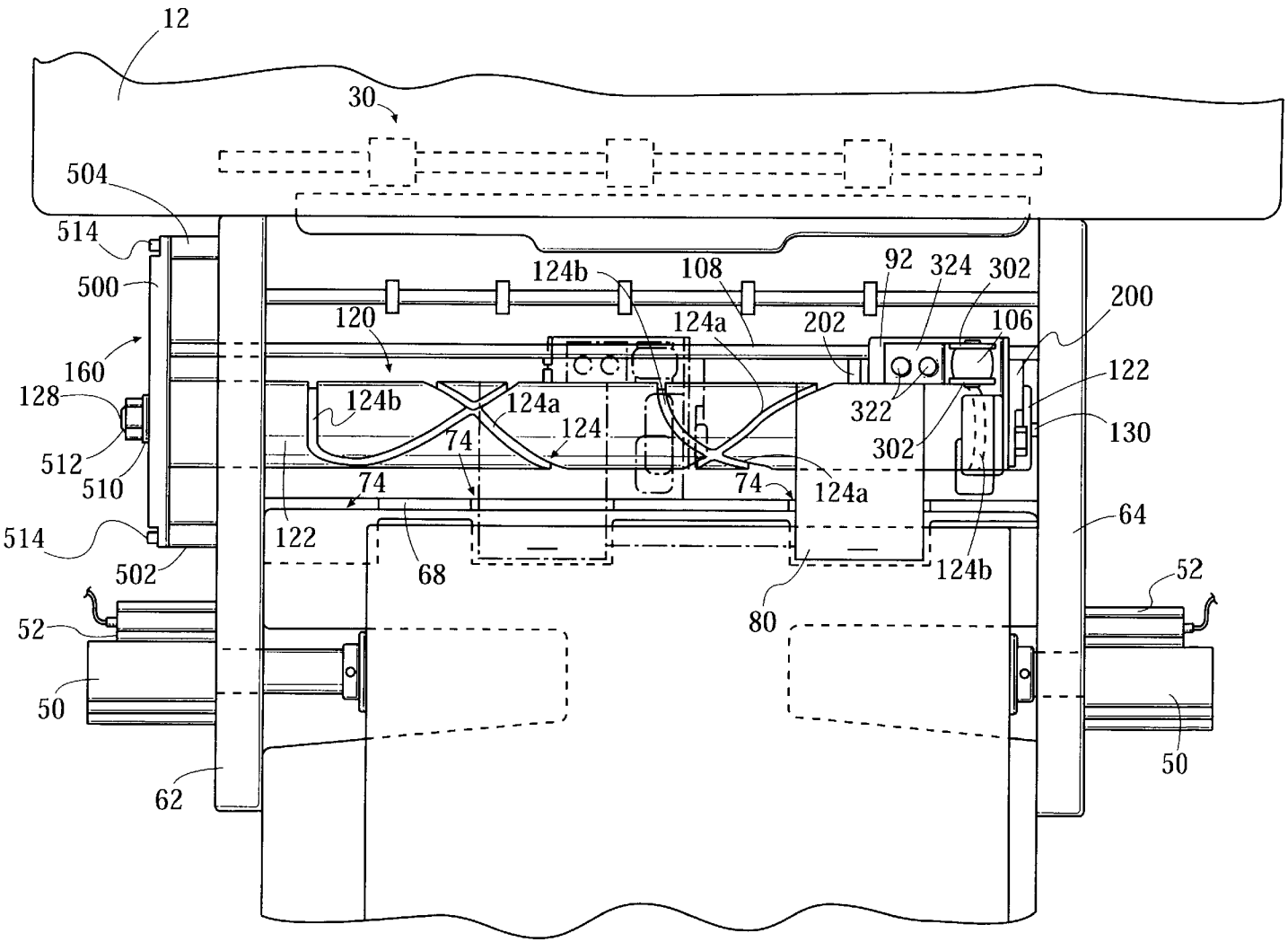
FIG. 5 shows a top plan view of the apparatus shown in FIGS. 1–4.

Turning to FIGS. 3 and 5 there is illustrated the free end mounting plate mechanism 160. The free end mounting plate mechanism 160 may include a free end mounting plate 500, which may be attached to and separated from the external side of the front end wall 62 of the frame 60 by a pair of free end mounting plate 500 side plates 502 and 504, to which the free end mounting plate 500 may be attached by screws 514. The respective side plates 502 and 504 may be attached to the front wall 62 of the frame 60 by a pair of screws 506 and held in place by, e.g., retainers 526 and 528 as shown in more detail in FIG. 4. The retainers 526 and 528 may be positioned on the interior side of the front wall 62 of the frame 60. The free end mounting plate 500 may have a pair of openings in it for receiving, e.g., a radial ball bearing 510, e.g., a 608 2 RS1 O10 radial ball bearing, through which may extend the helix 122 axle 128. The axle 128 may then be secured in place by, e.g., a hex nut M8 512 and a washer (not shown). A second opening in the free end mounting plate 500 may house a spacer (not shown) and an inserted portion of an oil bronze bearing 520, e.g., an ISO 2795 O10/O16x16-O22x3 bearing, into which may extend the translation assembly 100 pivot arm 112*b* pivot pin 114*b*. The free end mounting assembly 160 side plate 504 may be fashioned with a slotted portion 530 allowing for the extension of a coil retraction spring (not shown) between, e.g., the axle 128 and the translation assembly 100.

Turning now to FIG. 8 there is shown an exploded view of a portion of an embodiment of the present invention, which includes the finisher/stapler, 80 and its carriage assembly 90. The carriage assembly 90, as noted above, may include a base plate 92 and a pair of vertically extending side walls 94 and 96, each of which may have a pair of openings 278, through which may extend in the one instance the union assembly axle 260 and in the second instance the translation assembly 100 axle 108. Extending into each of the openings 278 on each of the side plates 94 and 96 associated with the union assembly axle 260 are respectively a bearing 280*a* and a bearing 280*b*, which may be, e.g., an oil bronze bearing ISO 2795 O10/O16x8-O20x3 bearing, which may receive and hold the base plate 92 for pivoting motion on the union assembly 126 axle 260. Extending into each of the openings 278 on each of the side plates 94 and 96 associated with the translation assembly 100 axle 108 are respectively a bearing 280*c* (not shown) and a bearing 280*d*, which may be, e.g., an oil bronze bearing ISO 2795 O10/O16x8-O20x3 bearing, which may receive and hold the base plate 92 for pivoting motion on the translation assembly 100 axle 108.

The finisher/stapler 80 may be attached to the base plate 92 by a plurality of screws (not shown). The tower 300 of the wedge roller assembly 102 may be attached to the base plate 92 by a pair of screws 322, which may be, e.g., M5x25 hex socket cap screws, and which may extend through a lateral extension 324 of the tower 300. Adjacent the finisher/stapler 80 may be a engaged/not-engaged switch 312, which may be attached to a vertical extension 313 of the base plate 92 above the side plate 94 by a pair of screws 320, which may be, e.g., hex socket cap screws M26x12. The switch 312 may have an operating mechanism 314 and a tripping lever 310, which may be pivotally attached to the underside of the switch 312, such that movement of the tripping lever 380 toward the underside of the switch 312 will move the operating mechanism 314 of the switch 312 to the closed position. The switch 312 may also have a pair of contact leads 340*a* and 340*b*, e.g., for click on wire connections and a similar click on wire connection common contact 342. The switch 312 provides information to the controller for the present invention, as explained in more detail below. The operating mechanism 314 may also be spring biased in the open position. The switch 312 may be, e.g., a V3L-1108-08 switch made, e.g., by Microswitch of Freeport Ill. The lead 342 may be, e.g., a common lead and the lead 340*a* may be, e.g., a normally open lead and the lead 340*b* may be, e.g., a normally closed lead. Therefore, if the controller, e.g., a controller circuit, in which switch is present is set up to have the switch 312 be normally open, then the action of the actuating lever 380 moving toward the body of the switch 312 shuts the switch 312 as seen by the control circuit. If the circuit is set up to have the switch 312 be normally closed, then the action of the actuating lever 310 moving toward the body of the switch 312 opens the stitch 312 as seen by the circuit. The switch 312 may be mounted to the base plate 92 with the lever arm 310 extending through an opening 316 in the base plate 92.

Figure 6:
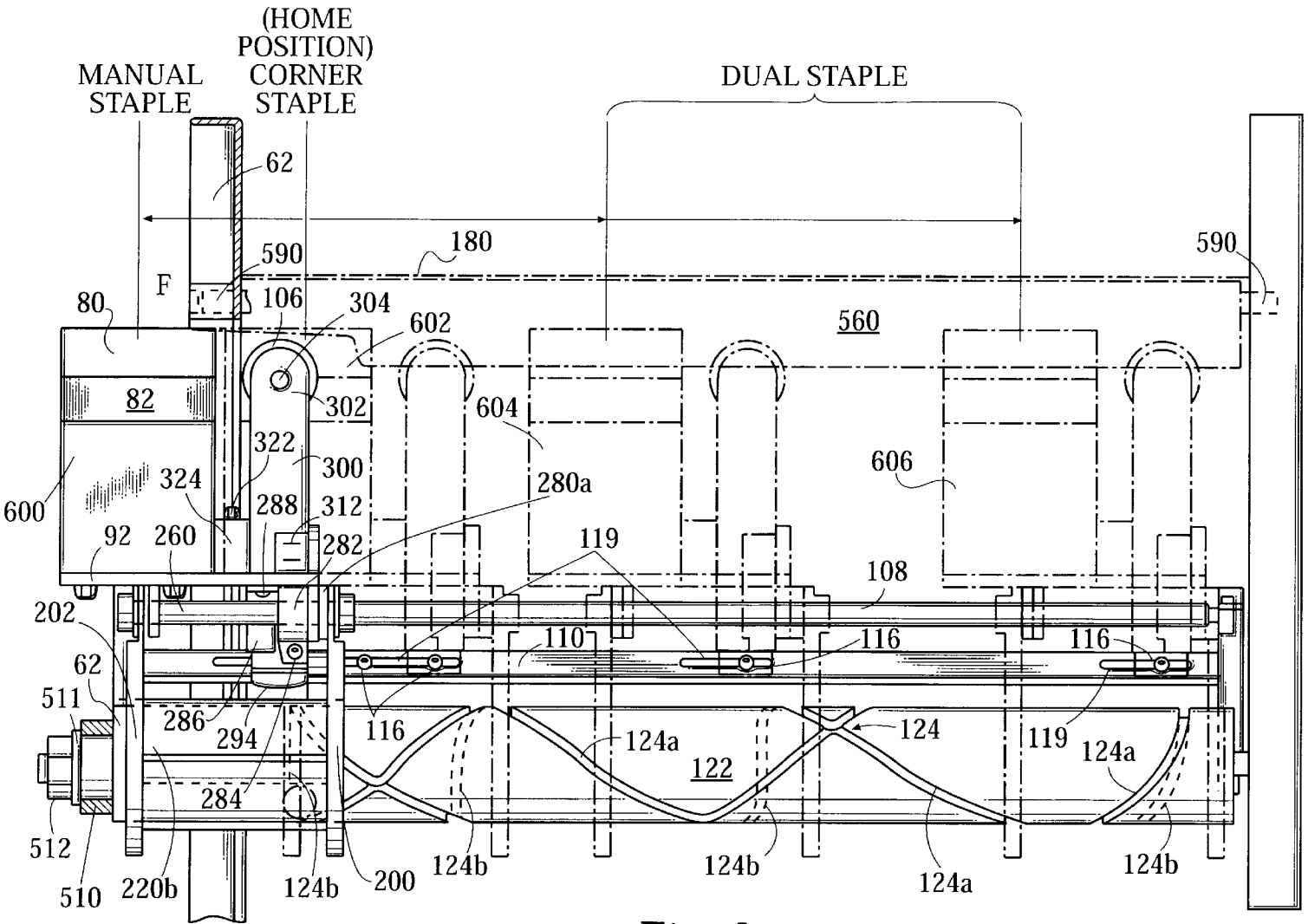
FIG. 6 shows a right side view of the apparatus shown in FIGS. 1–5.

Turning now to FIGS. 4, 6 and 8 there is shown the interaction of the translation mechanism 100 switch beam 110 and the switch 312. As can be seen in more detail in the cross-sectional view of FIG. 4, the translation mechanism 100 switch beam 110 may comprise a u-shaped beam that may be attached at either end to the respective translation mechanism front and rear link bars 112*a* and *b*, by a hex nut screw, e.g., the hex nut screw 258 shown in FIG. 4 attaching the translation mechanism 100 switch beam 110 to the front link bar 112*b*. As seen in more detail, e.g., in FIG. 6, displaced at intervals along the translation mechanism 100 switch beam 110 may be a plurality of slots 119. In each of the slots may be, e.g., at least one switch screw 116, each of which may be positioned along the slot at a desired location and held in place by a nut 118. As shown in more detail in FIG. 4, as the finisher/stapler carrier assembly 90 moves along the translation mechanism axle 108, a translation axle switch assembly 290 may interact with one of the switch screws 116. The switch assembly 290 may comprise a translation axle switch arm 294 that may be pivotally mounted on the axle 108. The switch arm 294 may have attached to it by, e.g., a pair of screws 296 an l-shaped switch trigger place which may abut and engage the switch lever arm 310. As can be seen, when the switch arm 294 engages a switch screw 116, the switch arm 294 moves to force the switch trigger plate 298 against the switch lever arm 310 to actuate the switch mechanism314.

Also shown in FIG. 4 in a partially cut-away portion 252, is a partially cut-away view of the attachment of the translation mechanism 100 front link bar 112*b* to the translation mechanism front link pin 114*b*, which may be accomplished by forming the link bar 112*b* with a u-shaped clamp 256 at the end, opening to a circular link pin 114*b* receiving opening, and tightening the u-clamp 256 with, e.g., a hex head screw 254.

Turning now to FIG. 6, there is shown an illustration of the overall operation of the finisher/stapler assembly 40. The finisher/stapler 80 is shown in FIG. 6 to be in a first finishing station position, which may be a manual stapling position. In this case, the housing 22 of the finisher 14 may have an opening (not shown) through which a user can insert a stack of sheets for finishing, e.g., by stapling, into the finisher/stapler 80 operating opening 82 while the finisher/stapler assembly 80 is in the position shown in FIG. 6 for finishing, e.g., by stapling, the set of sheets. Also shown in FIG. 6, in phantom, are the locations of a plurality of set finishing stations, e.g., a manual finishing station position 600, a corner finishing station position 602, a first dual finishing station position 604 and a second dual finishing station position 606. These may be the locations selected for finishing a set of sheets, e.g., the set 550, as shown in FIG.

4, at each of the plurality of set finishing stations 602, 604 and 606, or a sub-set of these, e.g., by stapling the set 550 at one or more locations along one edge 552 of the sheets 550.

As shown in more detail in FIG. 6, the regions of lesser pitch 124*b* of the helix groove 124 may be positioned at either end of the helix 122 as part of, e.g., a transition of the movement of the carriage assembly 90 from a first direction of movement, e.g., from right to left as shown in FIG. 6, i.e., from the manual finishing position 600 to the right hand end of the helix 122, where the helix follower boat 224 will transition into a more highly pitched portion 124*a* of the helix groove 122 which will carry the carriage assembly 90 in the reverse direction, i.e., from right to left as shown in FIG. 6, back toward the manual finishing position 600. Similarly at the left hand end of the helix 122 a similar transition can occur for the helix follower boat to transition into a more highly pitched section 124*a* of the helix groove 124 for movement back in the direction of the right hand end of the helix 122. It will be understood, that continuous rotation of the helix 122 in one direction, e.g., the clockwise direction as shown in FIGS. 2 and 3 will result in the carriage assembly 90 continuously moving back and forth generally along the length of the helix 122 with the helix groove follower boat 224 traveling in the helix groove 122.

Turning to FIG. 4 it can be seen that, essentially at any position of the carriage assembly along the helix 122, if the direction of the rotation of the drive motor 362 output shaft 363 in the opposite direction from that used to cause movement of the carriage assembly 90 along the helix 122, i.e., in the counterclockwise direction as shown in FIGS. 2 and 3, the carriage assembly 90 may also be moved, e.g., from a retracted position shown in FIG. 4 to an operating position, shown in phantom in FIG. 4. This may be accomplished due, e.g., to the action of the one-way clutch 382 on the rear link bar 112*a* pivot pin 114*b* engaging the pivot pin 114*b* when the direction of rotation of the clutch pulley 380 is reversed. This in turn may serve to rotate the link arms 112*a* and 112*b* in the counterclockwise direction as shown in FIG. 4, and along with the link arms 112*a* and 112*b* the entire carriage assembly 90 may be moved from the retracted position shown in FIG. 4 to the operating position shown in phantom in FIG. 4. As the carriage assembly 90 is moved from the retracted position shown in FIG. 4 to the operating position shown in phantom in FIG. 4, the switch trigger plate 298 may temporarily disengage its contact with the switch lever arm 310 and may serve then to disengage the switch operating mechanism 314. As the carriage assembly 90 is moved from the retracted position shown in FIG. 4 to the operating position shown in phantom in FIG. 4, a union axle switch arm 282, which may be fixedly attached to the union axle 260 by the tightening of a hex head screw 284 may be rotated by the rotation of the union axle 260 into a position to reengage the switch lever arm 380 to reengage the switch 312 operating mechanism 314. As noted above, the controller, as explained in more detail below, may be set up to treat the switch as a normally open or normally shot switch, or at different times one or the other of these, and will take an input signal from the normally open switch contact 340*a* or the normally shut switch contact 340*b*, as appropriate. As shown in more detail in FIGS. 6 and 8, a fixed l-shaped leaf spring 286 may be attached to the underside of the carriage assembly 90 base plate 92 by a hex head screw 288. The switch arm 282 engages the switch lever arm 310 after the switch arm 294 disengages with switch lever arm 310 as the stapler 80 is moved to the engaging position. The leaf spring 286 serves to assist in disengaging the spring arm 294 from the spring lever arm 310 as this movement of the stapler 80 occurs and insures that the spring lever arm 310 moves to an off position before the spring arm 282 reengages the spring lever arm 310.

Returning now to FIG. 6, it will be understood that the just described operation of the carriage assembly 90 in moving from the retracted position to the operating position may occur at any point along the helix 122, simply by stopping the rotation of the drive motor 362 output shaft 363 in the clockwise direction as shown in FIGS. 2 and 3 and reversion that motion to engage the one way clutch 382. The controller may be signaled that it is time for so stopping the rotation of the drive motor 362 output shaft 363 by the appropriate positioning of a switch screw 116 along the switch beam 110 to engage the translation mechanism 100 axle 108 switch arm 294. As shown in FIG. 6, the engagement by the switch arm 294 of a switch screw 116 may be utilized to indicate to the controller, through the switch 312 that the carriage assembly is in one of the finishing station positions 600, 602, 604 or 606, respectively.

Conveniently, in order, e.g., to slow the lateral movement of the carriage assembly 90 along the helix in the regions of the respective finishing stations 600, 602, 604 and 606, the helix groove 122 may be provided with a region of reduced pitch 124*b* at each such location. Thus, such factors as delay in the removal of power to the motor 362 by the controller, as explained in more detail below, or misalignment of a switch screw or the like may be minimized in their effect of having the carriage assembly misaligned to a desired finishing station position. This is so, because the lateral motion of the carriage assembly 90 may be minimized where the helix groove 122 follower boat 224 is traveling through a region of reduced pitch 124*b* at the respective locations along the helix 122 of the finishing station positions. It will be understood that the return track of the helix groove 122 need not have such regions of reduced pitch, unless it is desired to facilitate enabling the controller to stop the carriage assembly at the respective finishing stations, 600, 602, 604 or 606 on both the outward journey, e.g., to the right in FIG. 6 from the manual finishing/stapling position 600 to the right-most position 606 and on the opposite return journey.

Figure 7:
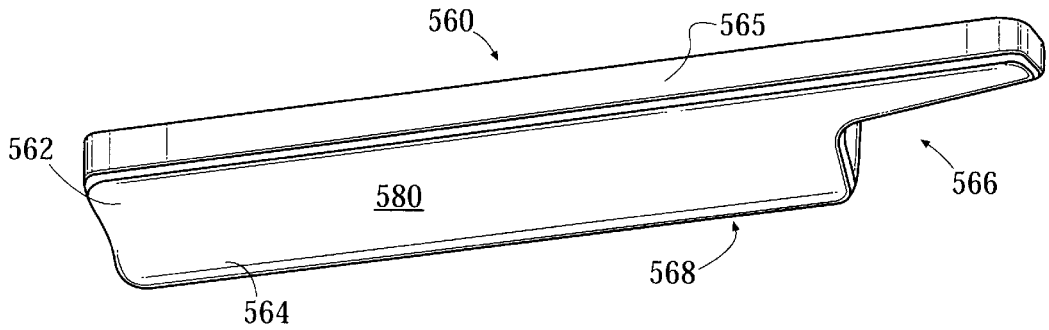
FIG. 7 shows a perspective view of a wedge member useful in an embodiment of the present invention and shown in phantom in FIG. 6; and, FIG. 8 shows an exploded view of a portion of an embodiment of the present invention.

Turning to FIGS. 4 and 6, the operation of the wedge plate 560 and the wedge roller assembly 102 can be seen. The wedge plate 560, as shown in FIG. 7 in perspective view, may be attached to the underside of the paper guide plate 180. The paper guide plate 180 may be pivotally mounted to the frame 60 by a pivot plate 570, which may be attached to a vertical side wall 580 of the paper guide plate 180 by a pair of screws 582. As shown in more detail in FIG. 2, the mounting block 570 may have attached to it a pivot pin 590, which may be inserted into a pivot pin opening (not shown), e.g., in the front side wall 62 of the frame 60. The opposing end of the paper guide plate 180 may be similarly pivotally attached by a pivot pin 590 to a pivot pin opening 592 in the rear side wall 64 of the frame 60. The wedge plate 560 may have a front side wall 568 and a rear side wall 565, and a notched section 566, where the front side wall 568 and the rear side wall 565 are closer together forming the notched section 566 to accommodate the lowering of the paper guide plate when the finisher/stapler assembly 40 is in, e.g., a home position, e.g., position 600 shown in FIG. 6.

As the carriage assembly 90 moves laterally along the helix 122, the wedge roller ball 106 of the wedge roller assembly 102 engages the underside of the wedge 560, in the regions where the wedge is positioned, as shown in more detail in FIG. 6. As shown in more detail in FIG. 4, the wedge is positioned to have its curved underside 570, which increases in slope from a trailing edge 562 of the wedge 560 to a leading edge 564 of the wedge plate 560. As the carriage assembly moves from the retracted position shown in FIG. 4 to the operating position shown in phantom in FIG. 4, the roller ball 106 engaging the underside 570 of the wedge plate 560 can serve to move the paper guide plate 180 from the position shown in FIG. 4 to the position shown in phantom in FIG. 4. This can therefore serve the function of moving the paper guide plate 180 out of the way of the finisher/stapler 80 in the operating position shown in phantom in FIG. 4.

We claim:

1. A set finishing apparatus adapted for use with an image producing machine discharging sheets of paper in sets that are arranged for finishing, comprising:

a moveable set finishing unit having a home position and a plurality of set finishing station positions located generally along a longitudinal axis, and having at least at each finishing station position a retracted position and an operating position, with each respective finishing station retracted position and operating position displaced from each other generally orthogonally to the longitudinal axis;

a drive motor having an output drive shaft;

a translational drive mechanism comprising a rotating shaft mounted generally parallel to the to the longitudinal axis and operatively connected to the drive motor output drive shaft and adapted to rotate in a rotating direction in response to rotation of the drive motor output drive shaft in a rotating direction; and, the moveable set finishing station being operatively connected to the rotating shaft of the translational drive mechanism in such a way as to be moved sequentially through each of the set finishing station positions and returned to the home position without changing the rotating direction of the drive motor output drive shaft or the rotating direction of the translational drive mechanism rotating shaft.

2. The apparatus of claim 1 further comprising:

the translational drive mechanism being adapted to move the moveable set finishing unit out of the retracted position and into the operating position by changing the rotating direction of the drive motor output shaft.

3. The apparatus of claim 1 further comprising:

the translational drive mechanism rotating shaft further comprising:

an generally cylindrical outer surface of the rotating shaft having formed therein a traveling track groove; and the moveable set finishing unit further comprising:

a traveling track groove follower attached to the moveable set finishing unit and adapted to engage the traveling track groove and move within the traveling track groove when the translational drive mechanism rotating shaft is rotated.

4. The apparatus of claim 2 further comprising:

the translational drive mechanism rotating shaft further comprising:

an generally cylindrical outer surface of the rotating shaft having formed therein a traveling track groove; and the moveable set finishing unit further comprising:

a traveling track groove follower attached to the moveable set finishing unit and adapted to engage the traveling track groove and move within the traveling track groove when the translational drive mechanism rotating shaft is rotated.

5. The apparatus of claim 3 further comprising:

the traveling track groove further comprising:

a generally helical groove having a first translational section adapted to move the traveling track groove follower in a first translational direction when the translational drive mechanism rotating shaft is rotated in the rotating direction such that the moveable set finishing station moves in the first translational direction to a position of maximum displacement along the longitudinal axis in the first translational direction and a second translational section adapted to move the traveling track groove follower in a second translational direction generally the reverse of the first translational direction and away from the position of maximum displacement along the longitudinal axis when the translational drive mechanism rotating shaft is continued to rotate in the rotating direction.

6. The apparatus of claim 4 further comprising:

the traveling track groove further comprising:

a generally helical groove having a first translational section adapted to move the traveling track groove follower in a first translational direction when the translational drive mechanism rotating shaft is rotated in the rotating direction such that the moveable set finishing station moves in the first translational direction to a position of maximum displacement along the longitudinal axis in the first translational direction and a second translational section adapted to move the traveling track groove follower in a second translational direction generally the reverse of the first translational direction and away from the position of maximum displacement along the longitudinal axis when the translational drive mechanism rotating shaft is continued to rotate in the rotating direction.

7. The apparatus of claim 5 further comprising:

in at least one of the first translational section and the second translational section the generally helical groove further comprising at least one generally flattened portion aligned with at least some of the plurality of finishing stations and adapted to permit motion of the traveling track groove follower in a direction generally orthogonal to the longitudinal axis.

8. The apparatus of claim 6 further comprising:

in at least one of the first translational section and the second translational section the generally helical groove further comprising at least one generally flattened portion aligned with at least some of the plurality of finishing stations and adapted to permit motion of the traveling track groove follower in a direction generally orthogonal to the longitudinal axis.

9. The apparatus of claim 7 further comprising:

the traveling track groove further comprising a generally flattened portion positioned at the position of maximum displacement in the first translational direction.

10. The apparatus of claim 8 further comprising:

the traveling track groove further comprising a generally flattened portion positioned at the position of maximum displacement in the first translational direction.

11. The apparatus of claim 9 further comprising:

the position of maximum displacement in the first translational direction also corresponds to one of the plurality of set finishing stations.

12. The apparatus of claim 10 further comprising:

the position of maximum displacement in the first translational direction also corresponds to one of the plurality of set finishing stations.

13. The apparatus of claim 9 further comprising:

a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position; and, a wedge engaging member contained on the moveable finishing unit and adapted to engage the curved surface on the wedge plate as the moveable finishing unit moves in the direction of movement from the retracted position to the operating position, to thereby pivot the pivotally mounted tray away from the moveable finishing unit.

14. The apparatus of claim 10 further comprising:

a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position; and, a wedge engaging member contained on the moveable finishing unit and adapted to engage the curved surface on the wedge plate as the moveable finishing unit moves in the direction of movement from the retracted position to the operating position, to thereby pivot the pivotally mounted tray away from the moveable finishing unit.

15. The apparatus of claim 11 further comprising:

a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position; and, a wedge engaging member contained on the moveable finishing unit and adapted to engage the curved surface on the wedge plate as the moveable finishing unit moves in the direction of movement from the retracted position to the operating position, to thereby pivot the pivotally mounted tray away from the moveable finishing unit.

16. The apparatus of claim 12 further comprising:

a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position; and, a wedge engaging member contained on the moveable finishing unit and adapted to engage the curved surface on the wedge plate as the moveable finishing unit moves in the direction of movement from the retracted position to the operating position, to thereby pivot the pivotally mounted tray away from the moveable finishing unit.

17. The apparatus of claim 13 further comprising:

the finishing unit comprises an electrically operated finishing mechanism; and, wherein movement of the moveable finishing unit at a respective finishing station from the retracted position to the operating position actuates an electrical switch to operate the moveable finishing unit to perform the finishing operation.

18. The apparatus of claim 14 further comprising:

the finishing unit comprises an electrically operated finishing mechanism; and, wherein movement of the moveable finishing unit at a respective finishing station from the retracted position to the operating position actuates an electrical switch to operate the moveable finishing unit to perform the finishing operation.

19. The apparatus of claim 15 further comprising:

the finishing unit comprises an electrically operated finishing mechanism; and, wherein movement of the moveable finishing unit at a respective finishing station from the retracted position to the operating position actuates an electrical switch to operate the moveable finishing unit to perform the finishing operation.

20. The apparatus of claim 16 further comprising:

the finishing unit comprises an electrically operated finishing mechanism; and, wherein movement of the moveable finishing unit at a respective finishing station from the retracted position to the operating position actuates an electrical switch to operate the moveable finishing unit to perform the finishing operation.

21. The apparatus of claim 17 wherein the finishing unit is a stapler.

22. The apparatus of claim 18 wherein the finishing unit is a stapler.

23. The apparatus of claim 19 wherein the finishing unit is a stapler.

24. The apparatus of claim 20 wherein the finishing unit is a stapler.

25. A set finishing apparatus adapted for use with an image producing machine discharging sheets of paper in sets that are arranged for finishing, comprising:

a moveable set finishing unit having a home position and a plurality of set finishing station positions located generally along a longitudinal axis, and having at least at each finishing station position a retracted position and an operating position, with each respective finishing station retracted position and operating position displaced from each other generally orthogonally to the longitudinal axis;

a drive motor having an output drive shaft;

a translational drive means comprising a rotating shaft mounted generally parallel to the to the longitudinal axis and operatively connected to the drive motor output drive shaft for to rotating in a rotating direction in response to rotation of the drive motor output drive shaft in a rotating direction; and, the moveable set finishing station including means operatively connecting the moveable set finishing unit to the rotating shaft of the translational drive means for moving the set finishing unit sequentially through each of the set finishing station positions and returning the set finishing unit to the home position without changing the rotating direction of the drive motor output drive shaft or the rotating direction of the translational drive mechanism rotating shaft.

26. The apparatus of claim 25 further comprising:

the translational drive means including engagement means for moving the moveable set finishing unit out of the retracted position and into the operating position by changing the rotating direction of the drive motor output shaft.

27. The apparatus of claim 25 further comprising:

the translational drive means rotating shaft further comprising:

an generally cylindrical outer surface of the rotating shaft having formed therein a traveling track groove; and the moveable set finishing unit further comprising:

a traveling track groove follower attached to the moveable set finishing unit and adapted to engage the traveling track groove and move within the traveling track groove when the translational drive means rotating shaft is rotated.

28. The apparatus of claim 26 further comprising:

the translational drive means rotating shaft further comprising:

an generally cylindrical outer surface of the rotating shaft having formed therein a traveling track groove; and the moveable set finishing unit further comprising:

a traveling track groove follower attached to the moveable set finishing unit and adapted to engage the traveling track groove and move within the traveling track groove when the translational drive means rotating shaft is rotated.

29. The apparatus of claim 27 further comprising:

the traveling track groove further comprising:

a generally helical groove having a first translational section adapted to move the traveling track groove follower in a first translational direction when the translational drive mechanism rotating shaft is rotated in the rotating direction such that the moveable set finishing station moves in the first translational direction to a position of maximum displacement along the longitudinal axis in the first translational direction and a second translational section adapted to move the traveling track groove follower in a second translational direction generally the reverse of the first translational direction and away from the position of maximum displacement along the longitudinal axis when the translational drive mechanism rotating shaft is continued to rotate in the rotating direction.

30. The apparatus of claim 28 further comprising:

the traveling track groove further comprising:

a generally helical groove having a first translational section adapted to move the traveling track groove follower in a first translational direction when the translational drive mechanism rotating shaft is rotated in the rotating direction such that the moveable set finishing station moves in the first translational direction to a position of maximum displacement along the longitudinal axis in the first translational direction and a second translational section adapted to move the traveling track groove follower in a second translational direction generally the reverse of the first translational direction and away from the position of maximum displacement along the longitudinal axis when the translational drive mechanism rotating shaft is continued to rotate in the rotating direction.

31. The apparatus of claim 29 further comprising:

in at least one of the first translational section and the second translational section the generally helical groove further comprising at least one generally flattened portion aligned with at least some of the plurality of finishing stations to permit motion of the traveling track groove follower in a direction generally orthogonal to the longitudinal axis.

32. The apparatus of claim 30 further comprising:

in at least one of the first translational section and the second translational section the generally helical groove further comprising at least one generally flattened portion aligned with at least some of the plurality of finishing stations to permit motion of the traveling track groove follower in a direction generally orthogonal to the longitudinal axis.

33. The apparatus of claim 31 further comprising:

the traveling track groove further comprising a generally flattened portion positioned at the position of maximum displacement in the first translational direction.

34. The apparatus of claim 32 further comprising:

the traveling track groove further comprising a generally flattened portion positioned at the position of maximum displacement in the first translational direction.

35. The apparatus of claim 33 further comprising:

the position of maximum displacement in the first translational direction also corresponds to one of the plurality of set finishing stations.

36. The apparatus of claim 34 further comprising:

the position of maximum displacement in the first translational direction also corresponds to one of the plurality of set finishing stations.

37. The apparatus of claim 33 further comprising:

a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position; and, a wedge engaging means contained on the moveable finishing unit for moving the pivotally mounted tray away from the moveable set finishing unit as the moveable finishing unit moves in the direction of movement from the retracted position to the operating position.

38. The apparatus of claim 34 further comprising:

a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position; and, a wedge engaging means contained on the moveable finishing unit for moving the pivotally mounted tray away from the moveable set finishing unit as the moveable finishing unit moves in the direction of movement from the retracted position to the operating position.

39. The apparatus of claim 35 further comprising:

a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position; and, a wedge engaging means contained on the moveable finishing unit for moving the pivotally mounted tray away from the moveable set finishing unit as the moveable finishing unit moves in the direction of movement from the retracted position to the operating position.

40. The apparatus of claim 36 further comprising:

a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position; and, a wedge engaging means contained on the moveable finishing unit for moving the pivotally mounted tray away from the moveable set finishing unit as the moveable finishing unit moves in the direction of movement from the retracted position to the operating position.

41. The apparatus of claim 37 further comprising:

the finishing unit comprises an electrically operated finishing mechanism; and, wherein movement of the moveable finishing unit at a respective finishing station from the retracted position to the operating position actuates an electrical switch to operate the moveable finishing unit to perform the finishing operation.

42. The apparatus of claim 38 further comprising:

the finishing unit comprises an electrically operated finishing mechanism; and, wherein movement of the moveable finishing unit at a respective finishing station from the retracted position to the operating position actuates an electrical switch to operate the moveable finishing unit to perform the finishing operation.

43. The apparatus of claim 39 further comprising:

the finishing unit comprises an electrically operated finishing mechanism; and, wherein movement of the moveable finishing unit at a respective finishing station from the retracted position to the operating position actuates an electrical switch to operate the moveable finishing unit to perform the finishing operation.

44. The apparatus of claim 40 further comprising:

the finishing unit comprises an electrically operated finishing mechanism; and, wherein movement of the moveable finishing unit at a respective finishing station from the retracted position to the operating position actuates an electrical switch to operate the moveable finishing unit to perform the finishing operation.

45. The apparatus of claim 41 wherein the finishing unit is a stapler.

46. The apparatus of claim 42 wherein the finishing unit is a stapler.

47. The apparatus of claim 43 wherein the finishing unit is a stapler.

48. The apparatus of claim 44 wherein the finishing unit is a stapler.

49. A set finishing method for use with an image producing machine discharging sheets of paper in sets that are arranged for finishing, comprising:

utilizing a moveable set finishing unit having a home position having a plurality of set finishing station positions located generally along a longitudinal axis, and having at least at each finishing station position a retracted position and an operating position, with each respective finishing station retracted position and operating position displaced from each other generally orthogonally to the longitudinal axis;

providing a drive motor having an output drive shaft;

providing a translational drive mechanism means comprising a rotating shaft mounted generally parallel to the to the longitudinal axis and operatively connected to the drive motor output drive shaft, and rotating the translational drive mechanism in a rotating direction in response to rotation of the drive motor output drive shaft in a rotating direction; and, moving the set finishing unit sequentially through each of the set finishing station positions and returning the set finishing unit to the home position without changing the rotating direction of the drive motor output drive shaft or the rotating direction of the translational drive mechanism rotating shaft.

50. The method of claim 49 further comprising:

moving the moveable set finishing unit out of the retracted position and into the operating position by changing the rotating direction of the drive motor output shaft.

51. The method of claim 48 further comprising:

the step of moving the set finishing unit sequentially through each of the set finishing station positions further comprises:

utilizing an generally cylindrical outer surface of the rotating shaft having formed therein a traveling track groove; and utilizing a traveling track groove follower attached to the moveable set finishing unit engaging the traveling track groove and moving within the traveling track groove.

52. The method of claim 49 further comprising:

the step of moving the set finishing unit sequentially through each of the set finishing station positions further comprises:

utilizing an generally cylindrical outer surface of the rotating shaft having formed therein a traveling track groove; and utilizing a traveling track groove follower attached to the moveable set finishing unit engaging the traveling track groove and moving within the traveling track groove.

53. The method of claim 51 further comprising:

the traveling track groove further comprising:

a generally helical groove having a first translational section adapted to move the traveling track groove follower in a first translational direction when the translational drive mechanism rotating shaft is rotated in the rotating direction such that the moveable set finishing station moves in the first translational direction to a position of maximum displacement along the longitudinal axis in the first translational direction and a second translational section adapted to move the traveling track groove follower in a second translational direction generally the reverse of the first translational direction and away from the position of maximum displacement along the longitudinal axis when the translational drive mechanism rotating shaft is continued to rotate in the rotating direction.

54. The method of claim 52 further comprising:

the traveling track groove further comprising:

a generally helical groove having a first translational section adapted to move the traveling track groove follower in a first translational direction when the translational drive mechanism rotating shaft is rotated in the rotating direction such that the moveable set finishing station moves in the first translational direction to a position of maximum displacement along the longitudinal axis in the first translational direction and a second translational section adapted to move the traveling track groove follower in a second translational direction generally the reverse of the first translational direction and away from the position of maximum displacement along the longitudinal axis when the translational drive mechanism rotating shaft is continued to rotate in the rotating direction.

55. The method of claim 53 further comprising:

in at least one of the first translational section and the second translational section the generally helical groove further comprising at least one generally flattened portion aligned with at least some of the plurality of finishing stations to permit motion of the traveling track groove follower in a direction generally orthogonal to the longitudinal axis.

56. The method of claim 54 further comprising:

in at least one of the first translational section and the second translational section the generally helical groove further comprising at least one generally flattened portion aligned with at least some of the plurality of finishing stations to permit motion of the traveling track groove follower in a direction generally orthogonal to the longitudinal axis.

57. The method of claim 55 further comprising:

the traveling track groove further comprising a generally flattened portion positioned at the position of maximum displacement in the first translational direction.

58. The method of claim 56 further comprising:

the traveling track groove further comprising a generally flattened portion positioned at the position of maximum displacement in the first translational direction.

59. The method of claim 57 further comprising:

the position of maximum displacement in the first translational direction also corresponds to one of the plurality of set finishing stations.

60. The method of claim 58 further comprising:

the position of maximum displacement in the first translational direction also corresponds to one of the plurality of set finishing stations.

61. The method of claim 57 further comprising:

providing a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position; and, utilizing a wedge engaging means contained on the moveable finishing unit to move the pivotally mounted tray away from the moveable set finishing unit as the moveable finishing unit moves in the direction of movement from the retracted position to the operating position.

62. The method of claim 58 further comprising:

providing a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position; and, utilizing a wedge engaging means contained on the moveable finishing unit to move the pivotally mounted tray away from the moveable set finishing unit as the moveable finishing unit moves in the direction of movement from the retracted position to the operating position.

63. The method of claim 59 further comprising:

providing a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position; and, utilizing a wedge engaging means contained on the moveable finishing unit to move the pivotally mounted tray away from the moveable set finishing unit as the moveable finishing unit moves in the direction of movement from the retracted position to the operating position.

64. The method of claim 60 further comprising:

providing a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position; and, utilizing a wedge engaging means contained on the moveable finishing unit to move the pivotally mounted tray away from the moveable set finishing unit as the moveable finishing unit moves in the direction of movement from the retracted position to the operating position.

65. The method of claim 61 further comprising:

the finishing unit comprises an electrically operated finishing mechanism; and, upon movement of the moveable finishing unit at a respective finishing station from the retracted position to the operating position actuating an electrical switch to operate the moveable finishing unit to perform the finishing operation.

66. The method of claim 62 further comprising:

the finishing unit comprises an electrically operated finishing mechanism; and, upon movement of the moveable finishing unit at a respective finishing station from the retracted position to the operating position actuating an electrical switch to operate the moveable finishing unit to perform the finishing operation.

67. The method of claim 63 further comprising:

the finishing unit comprises an electrically operated finishing mechanism; and, upon movement of the moveable finishing unit at a respective finishing station from the retracted position to the operating position actuating an electrical switch to operate the moveable finishing unit to perform the finishing operation.

68. The method of claim 64 further comprising:

the finishing unit comprises an electrically operated finishing mechanism; and, upon movement of the moveable finishing unit at a respective finishing station from the retracted position to the operating position actuating an electrical switch to operate the moveable finishing unit to perform the finishing operation.

69. The method of claim 65 wherein the finishing unit is a stapler.

70. The method of claim 66 wherein the finishing unit is a stapler.

71. The method of claim 67 wherein the finishing unit is a stapler.

72. The method of claim 68 wherein the finishing unit is a stapler.

73. A set finishing apparatus adapted for use with an image producing machine discharging sheets of paper in sets that are arranged for finishing, comprising:

a moveable set finishing unit having a home position and a plurality of set finishing station positions located generally along a longitudinal axis, and having at least at each finishing station position a retracted position and an operating position, with each respective finishing station retracted position and operating position displaced from each other generally orthogonally to the longitudinal axis;

a drive motor having an output drive shaft;

a translational drive mechanism comprising a rotating shaft mounted generally parallel to the to the longitudinal axis and operatively connected to the drive motor output drive shaft and adapted to rotate in a rotating direction in response to rotation of the drive motor output drive shaft in a rotating direction;

the moveable set finishing station being operatively connected to the rotating shaft of the translational drive mechanism in such a way as to be moved sequentially through each of the set finishing station positions and returned to the home position without changing the rotating direction of the drive motor output drive shaft or the rotating direction of the translational drive mechanism rotating shaft; and, the translational drive mechanism being adapted to move the moveable set finishing unit out of the retracted position and into the operating position by changing the rotating direction of the drive motor output shaft.

74. A set finishing apparatus adapted for use with an image producing machine discharging sheets of paper in sets that are arranged for finishing, comprising:

a moveable set finishing unit having a home position and a plurality of set finishing station positions located generally along a longitudinal axis, and having at least at each finishing station position a retracted position and an operating position, with each respective finishing station retracted position and operating position displaced from each other generally orthogonally to the longitudinal axis;

a drive motor having an output drive shaft;

a translational drive mechanism comprising a rotating shaft mounted generally parallel to the to the longitudinal axis and operatively connected to the drive motor output drive shaft and adapted to rotate in a rotating direction in response to rotation of the drive motor output drive shaft in a rotating direction;

the moveable set finishing station being operatively connected to the rotating shaft of the translational drive mechanism in such a way as to be moved sequentially through each of the set finishing station positions and returned to the home position without changing the rotating direction of the drive motor output drive shaft or the rotating direction of the translational drive mechanism rotating shaft;

the translational drive mechanism being adapted to move the moveable set finishing unit out of the retracted position and into the operating position by changing the rotating direction of the drive motor output shaft;

the translational drive mechanism rotating shaft further comprising:

an generally cylindrical outer surface of the rotating shaft having formed therein a traveling track groove; and the moveable set finishing unit further comprising:

a traveling track groove follower attached to the moveable set finishing unit and adapted to engage the traveling track groove and move within the traveling track groove when the translational drive mechanism rotating shaft is rotated.

75. A set finishing apparatus adapted for use with an image producing machine discharging sheets of paper in sets that are arranged for finishing, comprising:

a moveable set finishing unit having a home position and a plurality of set finishing station positions located generally along a longitudinal axis, and having at least at each finishing station position a retracted position and an operating position, with each respective finishing station retracted position and operating position displaced from each other generally orthogonally to the longitudinal axis;

a drive motor having an output drive shaft;

a translational drive mechanism comprising a rotating shaft mounted generally parallel to the to the longitudinal axis and operatively connected to the drive motor output drive shaft and adapted to rotate in a rotating direction in response to rotation of the drive motor output drive shaft in a rotating direction;

the moveable set finishing station being operatively connected to the rotating shaft of the translational drive mechanism in such a way as to be moved sequentially through each of the set finishing station positions and returned to the home position without changing the rotating direction of the drive motor output drive shaft or the rotating direction of the translational drive mechanism rotating shaft;

the translational drive mechanism being adapted to move the moveable set finishing unit out of the retracted position and into the operating position by changing the rotating direction of the drive motor output shaft;

the translational drive mechanism rotating shaft further comprising:

an generally cylindrical outer surface of the rotating shaft having formed therein a traveling track groove; and the moveable set finishing unit further comprising:

a traveling track groove follower attached to the moveable set finishing unit and adapted to engage the traveling track groove and move within the traveling track groove when the translational drive mechanism rotating shaft is rotated; and, the traveling track groove further comprising:

a generally helical groove having a first translational section adapted to move the traveling track groove follower in a first translational direction when the translational drive mechanism rotating shaft is rotated in the rotating direction such that the moveable set finishing station moves in the first translational direction to a position of maximum displacement along the longitudinal axis in the first translational direction and a second translational section adapted to move the traveling track groove follower in a second translational direction generally the reverse of the first translational direction and away from the position of maximum displacement along the longitudinal axis when the translational drive mechanism rotating shaft is continued to rotate in the rotating direction.

76. A set finishing apparatus adapted for use with an image producing machine discharging sheets of paper in sets that are arranged for finishing, comprising:

a moveable set finishing unit having a home position and a plurality of set finishing station positions located generally along a longitudinal axis, and having at least at each finishing station position a retracted position and an operating position, with each respective finishing station retracted position and operating position displaced from each other generally orthogonally to the longitudinal axis;

a drive motor having an output drive shaft;

a translational drive mechanism comprising a rotating shaft mounted generally parallel to the to the longitudinal axis and operatively connected to the drive motor output drive shaft and adapted to rotate in a rotating direction in response to rotation of the drive motor output drive shaft in a rotating direction;

the moveable set finishing station being operatively connected to the rotating shaft of the translational drive mechanism in such a way as to be moved sequentially through each of the set finishing station positions and returned to the home position without changing the rotating direction of the drive motor output drive shaft or the rotating direction of the translational drive mechanism rotating shaft;

the translational drive mechanism being adapted to move the moveable set finishing unit out of the retracted position and into the operating position by changing the rotating direction of the drive motor output shaft;

the translational drive mechanism rotating shaft further comprising:

an generally cylindrical outer surface of the rotating shaft having formed therein a traveling track groove; and the moveable set finishing unit further comprising:

a traveling track groove follower attached to the moveable set finishing unit and adapted to engage the traveling track groove and move within the traveling track groove when the translational drive mechanism rotating shaft is rotated;

the traveling track groove further comprising:

a generally helical groove having a first translational section adapted to move the traveling track groove follower in a first translational direction when the translational drive mechanism rotating shaft is rotated in the rotating direction such that the moveable set finishing station moves in the first translational direction to a position of maximum displacement along the longitudinal axis in the first translational direction and a second translational section adapted to move the traveling track groove follower in a second translational direction generally the reverse of the first translational direction and away from the position of maximum displacement along the longitudinal axis when the translational drive mechanism rotating shaft is continued to rotate in the rotating direction; and in at least one of the first translational section and the second translational section the generally helical groove further comprising at least one generally flattened portion aligned with at least some of the plurality of finishing stations and adapted to permit motion of the traveling track groove follower in a direction generally orthogonal to the longitudinal axis.

77. A set finishing apparatus adapted for use with an image producing machine discharging sheets of paper in sets that are arranged for finishing, comprising:

a moveable set finishing unit having a home position and a plurality of set finishing station positions located generally along a longitudinal axis, and having at least at each finishing station position a retracted position and an operating position, with each respective finishing station retracted position and operating position displaced from each other generally orthogonally to the longitudinal axis;

a drive motor having an output drive shaft;

a translational drive mechanism comprising a rotating shaft mounted generally parallel to the to the longitudinal axis and operatively connected to the drive motor output drive shaft and adapted to rotate in a rotating direction in response to rotation of the drive motor output drive shaft in a rotating direction;

the moveable set finishing station being operatively connected to the rotating shaft of the translational drive mechanism in such a way as to be moved sequentially through each of the set finishing station positions and returned to the home position without changing the rotating direction of the drive motor output drive shaft or the rotating direction of the translational drive mechanism rotating shaft;

the translational drive mechanism being adapted to move the moveable set finishing unit out of the retracted position and into the operating position by changing the rotating direction of the drive motor output shaft;

the translational drive mechanism rotating shaft further comprising:

an generally cylindrical outer surface of the rotating shaft having formed therein a traveling track groove; and the moveable set finishing unit further comprising:

a traveling track groove follower attached to the moveable set finishing unit and adapted to engage the traveling track groove and move within the traveling track groove when the translational drive mechanism rotating shaft is rotated;

the traveling track groove further comprising:

a generally helical groove having a first translational section adapted to move the traveling track groove follower in a first translational direction when the translational drive mechanism rotating shaft is rotated in the rotating direction such that the moveable set finishing station moves in the first translational direction to a position of maximum displacement along the longitudinal axis in the first translational direction and a second translational section adapted to move the traveling track groove follower in a second translational direction generally the reverse of the first translational direction and away from the position of maximum displacement along the longitudinal axis when the translational drive mechanism rotating shaft is continued to rotate in the rotating direction;

in at least one of the first translational section and the second translational section the generally helical groove further comprising at least one generally flattened portion aligned with at least some of the plurality of finishing stations and adapted to permit motion of the traveling track groove follower in a direction generally orthogonal to the longitudinal axis; and, the traveling track groove further comprising a generally flattened portion positioned at the position of maximum displacement in the first translational direction.

78. A set finishing apparatus adapted for use with an image producing machine discharging sheets of paper in sets that are arranged for finishing, comprising:

a moveable set finishing unit having a home position and a plurality of set finishing station positions located generally along a longitudinal axis, and having at least at each finishing station position a retracted position and an operating position, with each respective finishing station retracted position and operating position displaced from each other generally orthogonally to the longitudinal axis;

a drive motor having an output drive shaft;

a translational drive mechanism comprising a rotating shaft mounted generally parallel to the to the longitudinal axis and operatively connected to the drive motor output drive shaft and adapted to rotate in a rotating direction in response to rotation of the drive motor output drive shaft in a rotating direction;

the moveable set finishing station being operatively connected to the rotating shaft of the translational drive mechanism in such a way as to be moved sequentially through each of the set finishing station positions and returned to the home position without changing the rotating direction of the drive motor output drive shaft or the rotating direction of the translational drive mechanism rotating shaft;

the translational drive mechanism being adapted to move the moveable set finishing unit out of the retracted position and into the operating position by changing the rotating direction of the drive motor output shaft;

the translational drive mechanism rotating shaft further comprising:

an generally cylindrical outer surface of the rotating shaft having formed therein a traveling track groove; and the moveable set finishing unit further comprising:

a traveling track groove follower attached to the moveable set finishing unit and adapted to engage the traveling track groove and move within the traveling track groove when the translational drive mechanism rotating shaft is rotated;

the traveling track groove further comprising:

a generally helical groove having a first translational section adapted to move the traveling track groove follower in a first translational direction when the translational drive mechanism rotating shaft is rotated in the rotating direction such that the moveable set finishing station moves in the first translational direction to a position of maximum displacement along the longitudinal axis in the first translational direction and a second translational section adapted to move the traveling track groove follower in a second translational direction generally the reverse of the first translational direction and away from the position of maximum displacement along the longitudinal axis when the translational drive mechanism rotating shaft is continued to rotate in the rotating direction;

in at least one of the first translational section and the second translational section the generally helical groove further comprising at least one generally flattened portion aligned with at least some of the plurality of finishing stations and adapted to permit motion of the traveling track groove follower in a direction generally orthogonal to the longitudinal axis;

the traveling track groove further comprising a generally flattened portion positioned at the position of maximum displacement in the first translational direction; and, the position of maximum displacement in the first translational direction also corresponds to one of the plurality of set finishing stations.

79. A set finishing apparatus adapted for use with an image producing machine discharging sheets of paper in sets that are arranged for finishing, comprising:

a moveable set finishing unit having a home position and a plurality of set finishing station positions located generally along a longitudinal axis, and having at least at each finishing station position a retracted position and an operating position, with each respective finishing station retracted position and operating position displaced from each other generally orthogonally to the longitudinal axis;

a drive motor having an output drive shaft;

a translational drive mechanism comprising a rotating shaft mounted generally parallel to the to the longitudinal axis and operatively connected to the drive motor output drive shaft and adapted to rotate in a rotating direction in response to rotation of the drive motor output drive shaft in a rotating direction;

the moveable set finishing station being operatively connected to the rotating shaft of the translational drive mechanism in such a way as to be moved sequentially through each of the set finishing station positions and returned to the home position without changing the rotating direction of the drive motor output drive shaft or the rotating direction of the translational drive mechanism rotating shaft;

the translational drive mechanism being adapted to move the moveable set finishing unit out of the retracted position and into the operating position by changing the rotating direction of the drive motor output shaft;

the translational drive mechanism rotating shaft further comprising:

an generally cylindrical outer surface of the rotating shaft having formed therein a traveling track groove; and the moveable set finishing unit further comprising:

a traveling track groove follower attached to the moveable set finishing unit and adapted to engage the traveling track groove and move within the traveling track groove when the translational drive mechanism rotating shaft is rotated;

the traveling track groove further comprising:

a generally helical groove having a first translational section adapted to move the traveling track groove follower in a first translational direction when the translational drive mechanism rotating shaft is rotated in the rotating direction such that the moveable set finishing station moves in the first translational direction to a position of maximum displacement along the longitudinal axis in the first translational direction and a second translational section adapted to move the traveling track groove follower in a second translational direction generally the reverse of the first translational direction and away from the position of maximum displacement along the longitudinal axis when the translational drive mechanism rotating shaft is continued to rotate in the rotating direction;

in at least one of the first translational section and the second translational section the generally helical groove further comprising at least one generally flattened portion aligned with at least some of the plurality of finishing stations and adapted to permit motion of the traveling track groove follower in a direction generally orthogonal to the longitudinal axis;

the traveling track groove further comprising a generally flattened portion positioned at the position of maximum displacement in the first translational direction;

the position of maximum displacement in the first translational direction also corresponds to one of the plurality of set finishing stations; and, a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position; and, a wedge engaging member contained on the moveable finishing unit and adapted to engage the curved surface on the wedge plate as the moveable finishing unit moves in the direction of movement from the retracted position to the operating position, to thereby pivot the pivotally mounted tray away from the moveable finishing unit.

80. A set finishing apparatus adapted for use with an image producing machine discharging sheets of paper in sets that are arranged for finishing, comprising:

a moveable set finishing unit having a home position and a plurality of set finishing station positions located generally along a longitudinal axis, and having at least at each finishing station position a retracted position and an operating position, with each respective finishing station retracted position and operating position displaced from each other generally orthogonally to the longitudinal axis;

a drive motor having an output drive shaft;

a translational drive mechanism comprising a rotating shaft mounted generally parallel to the to the longitudinal axis and operatively connected to the drive motor output drive shaft and adapted to rotate in a rotating direction in response to rotation of the drive motor output drive shaft in a rotating direction;

the moveable set finishing station being operatively connected to the rotating shaft of the translational drive mechanism in such a way as to be moved sequentially through each of the set finishing station positions and returned to the home position without changing the rotating direction of the drive motor output drive shaft or the rotating direction of the translational drive mechanism rotating shaft;

the translational drive mechanism being adapted to move the moveable set finishing unit out of the retracted position and into the operating position by changing the rotating direction of the drive motor output shaft;

the translational drive mechanism rotating shaft further comprising:

an generally cylindrical outer surface of the rotating shaft having formed therein a traveling track groove; and the moveable set finishing unit further comprising:

a traveling track groove follower attached to the moveable set finishing unit and adapted to engage the traveling track groove and move within the traveling track groove when the translational drive mechanism rotating shaft is rotated;

the traveling track groove further comprising:

a generally helical groove having a first translational section adapted to move the traveling track groove follower in a first translational direction when the translational drive mechanism rotating shaft is rotated in the rotating direction such that the moveable set finishing station moves in the first translational direction to a position of maximum displacement along the longitudinal axis in the first translational direction and a second translational section adapted to move the traveling track groove follower in a second translational direction generally the reverse of the first translational direction and away from the position of maximum displacement along the longitudinal axis when the translational drive mechanism rotating shaft is continued to rotate in the rotating direction;

in at least one of the first translational section and the second translational section the generally helical groove further comprising at least one generally flattened portion aligned with at least some of the plurality of finishing stations and adapted to permit motion of the traveling track groove follower in a direction generally orthogonal to the longitudinal axis;

the traveling track groove further comprising a generally flattened portion positioned at the position of maximum displacement in the first translational direction;

the position of maximum displacement in the first translational direction also corresponds to one of the plurality of set finishing stations; and, a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position;

a wedge engaging member contained on the moveable finishing unit and adapted to engage the curved surface on the wedge plate as the moveable finishing unit moves in the direction of movement from the retracted position to the operating position, to thereby pivot the pivotally mounted tray away from the moveable finishing unit; and, the finishing unit comprises an electrically operated finishing mechanism; and, wherein movement of the moveable finishing unit at a respective finishing station from the retracted position to the operating position actuates an electrical switch to operate the moveable finishing unit to perform the finishing operation.

81. A set finishing apparatus adapted for use with an image producing machine discharging sheets of paper in sets that are arranged for finishing, comprising:

a moveable set finishing unit having a home position and a plurality of set finishing station positions located generally along a longitudinal axis, and having at least at each finishing station position a retracted position and an operating position, with each respective finishing station retracted position and operating position displaced from each other generally orthogonally to the longitudinal axis;

a drive motor having an output drive shaft;

a translational drive mechanism comprising a rotating shaft mounted generally parallel to the to the longitudinal axis and operatively connected to the drive motor output drive shaft and adapted to rotate in a rotating direction in response to rotation of the drive motor output drive shaft in a rotating direction;

the moveable set finishing station being operatively connected to the rotating shaft of the translational drive mechanism in such a way as to be moved sequentially through each of the set finishing station positions and returned to the home position without changing the rotating direction of the drive motor output drive shaft or the rotating direction of the translational drive mechanism rotating shaft;

the translational drive mechanism being adapted to move the moveable set finishing unit out of the retracted position and into the operating position by changing the rotating direction of the drive motor output shaft;

the translational drive mechanism rotating shaft further comprising:

an generally cylindrical outer surface of the rotating shaft having formed therein a traveling track groove; and the moveable set finishing unit further comprising:

a traveling track groove follower attached to the moveable set finishing unit and adapted to engage the traveling track groove and move within the traveling track groove when the translational drive mechanism rotating shaft is rotated;

the traveling track groove further comprising:

a generally helical groove having a first translational section adapted to move the traveling track groove follower in a first translational direction when the translational drive mechanism rotating shaft is rotated in the rotating direction such that the moveable set finishing station moves in the first translational direction to a position of maximum displacement along the longitudinal axis in the first translational direction and a second translational section adapted to move the traveling track groove follower in a second translational direction generally the reverse of the first translational direction and away from the position of maximum displacement along the longitudinal axis when the translational drive mechanism rotating shaft is continued to rotate in the rotating direction;

in at least one of the first translational section and the second translational section the generally helical groove further comprising at least one generally flattened portion aligned with at least some of the plurality of finishing stations and adapted to permit motion of the traveling track groove follower in a direction generally orthogonal to the longitudinal axis;

the traveling track groove further comprising a generally flattened portion positioned at the position of maximum displacement in the first translational direction;

the position of maximum displacement in the first translational direction also corresponds to one of the plurality of set finishing stations; and, a pivotally mounted tray extending generally in the direction of the longitudinal axis, including a wedge plate having a curved lower surface with a curvature that increases the thickness of the wedge plate in the direction of movement of the moveable finishing unit from the retracted position to the operating position;

a wedge engaging member contained on the moveable finishing unit and adapted to engage the curved surface on the wedge plate as the moveable finishing unit moves in the direction of movement from the retracted position to the operating position, to thereby pivot the pivotally mounted tray away from the moveable finishing unit; and, the finishing unit comprises an electrically operated finishing mechanism;

wherein movement of the moveable finishing unit at a respective finishing station from the retracted position to the operating position actuates an electrical switch to operate the moveable finishing unit to perform the finishing operation; and, the finishing unit is a stapler.

* * * * *